US005692311A

United States Patent [19]

Paquin

[11] Patent Number: 5,692,311

[45] Date of Patent: Dec. 2, 1997

[54] SIDEBOARD CLAMP AND JIG APPARATUS

[76] Inventor: Bernard J. Paquin, P.O. Box 158, Wallingford, Vt. 05773

[21] Appl. No.: 582,435

[22] Filed: Jan. 3, 1996

[51] Int. Cl.[6] ..... G01B 3/30

[52] U.S. Cl. ..... 33/647; 33/649

[58] Field of Search ..... 33/648, 649, 411, 33/646, 647

[56] References Cited

U.S. PATENT DOCUMENTS

| | | | |
|---|---|---|---|
| 216,252 | 6/1879 | Allison | 33/647 |
| 298,682 | 5/1884 | Finch | 33/647 |
| 631,315 | 8/1899 | Meskill | 33/647 |
| 780,697 | 1/1905 | Adams | 33/649 |
| 844,612 | 2/1907 | Morris | 33/649 |
| 1,097,146 | 5/1914 | Snyder | 33/646 |
| 2,889,632 | 5/1959 | Longhi | 33/648 |
| 2,891,318 | 6/1959 | Harrison et al. | 33/648 |
| 4,183,144 | 1/1980 | Barnett, III | 33/649 |
| 4,473,100 | 9/1984 | Wheeler | 33/647 |
| 5,018,279 | 5/1991 | Williams | 33/648 |

*Primary Examiner*—Thomas B. Will
*Attorney, Agent, or Firm*—John J. Welch, Jr., Esq.

[57] ABSTRACT

The instant invention consists of a handholdable spring loaded clamp unit with a lower jaw and an upper jaw such that when the clamp is squeezed open and the lower jaw is placed up, under a course of lain sideboard, the clamp when released from being held in amenable to being supported against the outer face of the sideboard while also holding an L-shaped jig component which in turn holds an adjustable L-shaped jigstand upon the base of which there can rest the bottom edge of a course of sideboard to be lain affixed to the course of lain sideboard.

8 Claims, 7 Drawing Sheets

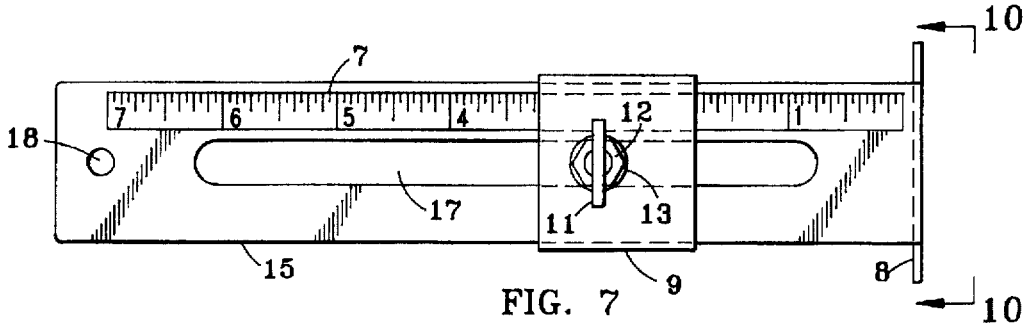
FIG. 7
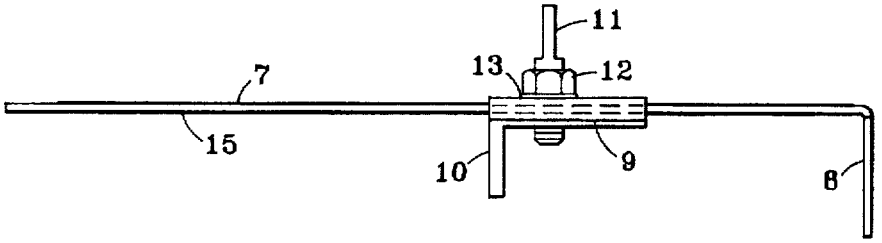
FIG. 8
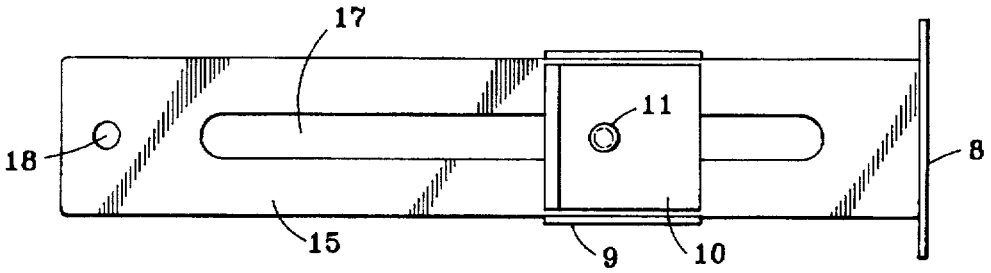
FIG. 9
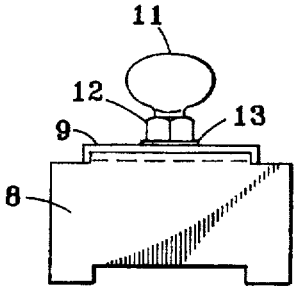
FIG. 10
FIG. 11
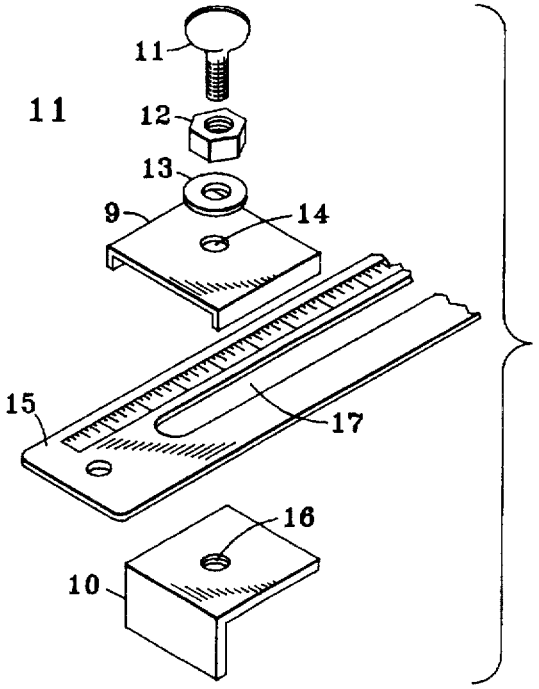

SIDEBOARD CLAMP AND JIG APPARATUS

CROSS-RELATED TO PARENT APPLICATIONS

There are no prior related or parent applications to which the instant applications may be referenced.

FEDERALLY SPONSORED RESEARCH AND DEVELOPMENT

The instant application is not supported by any federally sponsored research and development.

BACKGROUND OF THE INVENTION

1. Field of the Invention

The instant invention relates to those sorts of devices that serve to facilitate the application of sideboards or shingles to the outer walling of buildings or the laying of shingled roofs upon such buildings.

2. Information Regarding Related Art

The following references depict devices that perhaps resemble but which however do not anticipate the instant invention, to wit:

| Inventor | Invention | Patent No. | Date |
|---|---|---|---|
| 1. Van Der Meer | Cladding Plank Installation Tool | 5,370,377 | 12/6/94 |
| 2. C.L. Harrison Et Al | Shingle Positioning Gauge | 2,891,318 | 6/23/59 |
| 3. Sickler | Lap Siding Tool | 4,164,346 | 8/14/79 |
| 4. Singleterry | Tool for Lap Siding Installation | 5,319,909 | 6/14194 |
| 5. Lee | Clamp-On Gutter Holder | 5,240,234 | 8/31/93 |
| 6. V. Pizzani | Tile Set Tool | 2,630,702 | 3/10/53 |
| 7. Williams | Adjustable Locator For Furring Strips | 4,237,614 | 12/9/80 |
| 8. Barrera | Decking Clamp and Spacer | 5,190,266 | 3/2/93 |
| 9. E. H. Snyder | Siding Gage | 1,097,146 | 5/19/14 |

A SUMMARY OF THE INVENTION

A Brief Description of the Invention

The instant invention consists of a triangularly shaped spring loaded clamp unit together with an insertable jig component. When the clamp is squeezed open, it is then amenable to receipt of the jig component between its two jaws. When sideboard is sought to be applied to the outer walling of a building, first, a bottom course of such sideboard is nailed carefully in a level fashion to the bases of each of that building's outer sidewalls sought to be covered. Oftentimes, though not necessarily, a second course is then nailed to the upper portion of each of the bottom courses, about the sidewalls with care being taken to ensure that each second course is just as level with respect to the lie of the respective bases of that building's sidewalls being covered as is each bottom course. The instant invention is thereafter utilized in order to lay all of the remaining sideboards up the remainders of each of the sidewalls. An applicator squeezes the clamp unit of a first model of the instant invention open and fits the lower jaw of the clamp unit up, under the body of the second course of sideboard near one end of the sideboard. The applicator then fits the model's L shaped jig component between the upper jaw of the clamp and the outer face of the second course sidewall piece. The applicator then adjusts a moveable L shaped jigstand affixed to the jig component to a height above the base of the jig component that corresponds to the vertical distance desired as between the bottom edge of the second course and the bottom edge of the third course to be nailed to the upper portion of the second course and then tightens the jigstand to the jig component by way of an adjustable thumbscrew. The spring loaded character of the clamp unit then causes the clamp with supported jig between the clamp's upper jaw and previously lain i.e., second course's outer face to remain freely affixed to the outer face of the sideboard when the clamp is let go by the applicator. The applicator then squeezes the clamp unit of a second model of the instant invention open and then places the lower jaw of the clamp unit up, under the body of the second course sideboard or shingling piece near the other end of the piece. The applicator then repeats the process just performed with regards to utilization of the first model taking care to ensure that the height of the tightened jigstand endemic to the second model is the same as that of the tightened jigstand endemic to the first model. The third course of sideboard is then lain upon the bases of the two jigstands and nailed to the upper portion of the outer face of the second course. The clamp units of each model are then respectively squeezed open, the jig components are removed from the clamps and the clamps are removed from up, under the second course. The applicator then places the lower jaws of each squeezed open clamp up, under the just positioned third course and repeats the process outlined above with respect to both models for the purpose of laying a fourth course nailed to the upper portion of the just lain third course. The processes are then repeated until sideboard or shingling is so lain up the whole of the building sidewall then sought to be so covered. Finally, it should be noted that with respect to shingling rather than sideboard to be applied to the sidewalls of a building or that building's roof, a straight edge is utilized to be placed atop the bases of the jigstands and the shingling to be lain is then placed atop the straight edge and nailed directly into the sidewall or roof of the building to which it is being applied rather than, as is the case with respect to sideboard, into the upper portion of the outer face of the previously lain course.

Objects of the Invention

With regards to the manner in which sideboard or shingling is currently applied to the sidewalls of buildings or in which roofing shingles are currently applied to the topsides of buildings, it is necessary for two applicators to work together to ensure that the lie of each course of sideboard or shingling is level with respect to the lie of the course just below it to which it is being affixed. One applicator holds one end of a course to be applied fast to the corresponding end of the course just below it in anticipation of nailing the two together while a second applicator endeavors to hold the two together at precisely the same height between the base edges of each course in order to then nail one to the other such that the two will be level vis-a-vis one another. However, such an undertaking by any pair of applicators invariably invites some measure of leveling error per total sidewall. Also, the cost of employing two applicators per constructed sidewall is twice the cost of a need to employ only one such applicator. Utilization of the instant invention, two models at a time or, in some instances, as with respect to particularly long courses on wide sidewall, more than two models at a time ensures that leveling errors will absolutely not occur all, and, moreover enables construction costs to be instantly halved per unit application job.

Respectfully submitted, the instant new, unquestionably useful and indeed unique invention will operate to veritably revolutionize the manner in which sideboard is applied to buildings and in which roofing is lain on such buildings as well.

A DESCRIPTION OF THE DRAWINGS

7. FIG. 7 is a frontal plan view of the instant invention's jig component.

FIG. 8 is a lateral plan view of the instant invention's jig component.

FIG. 9 is a rear plan view of the instant invention's jig component.

FIG. 10 is a bottom plan view of the instant invention's jig component.

FIG. 11 is an exploded view of the jigstand portion of the instant invention's jig component in apposition to a cutaway frontal view of a portion of the jig component.

Figure 12:
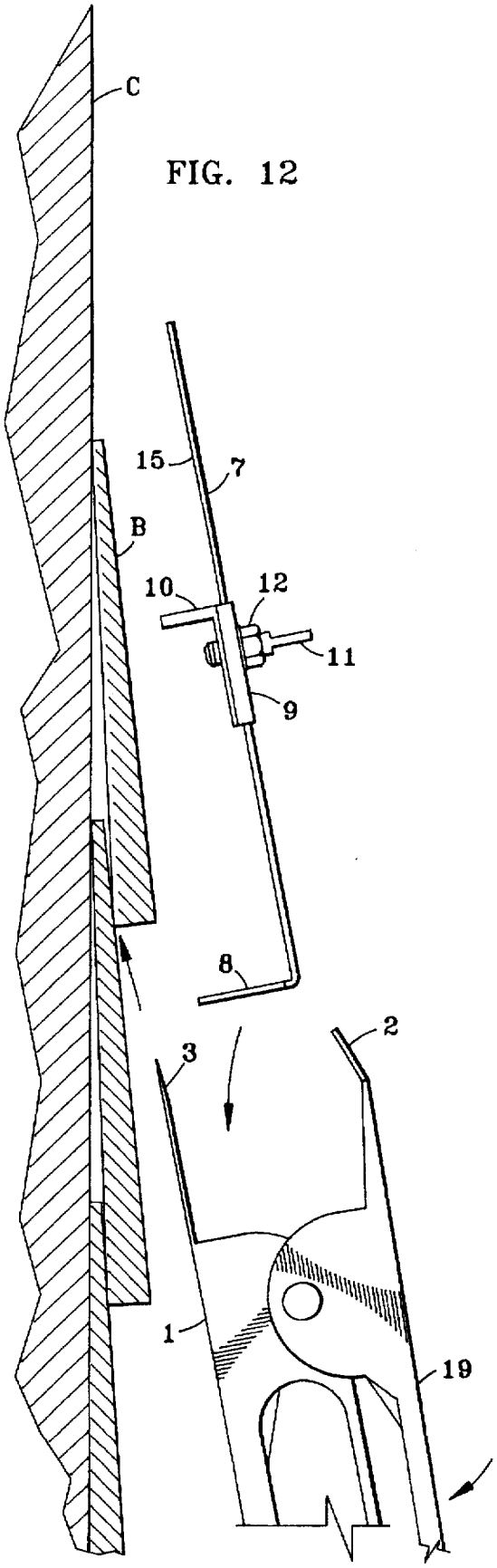

FIG. 12 is a lateral view of the instant invention's clamp unit with open jaws amenable to receipt of its jig component in apposition to one end of a course of sideboards on the sidewall of a building.

Figure 13:
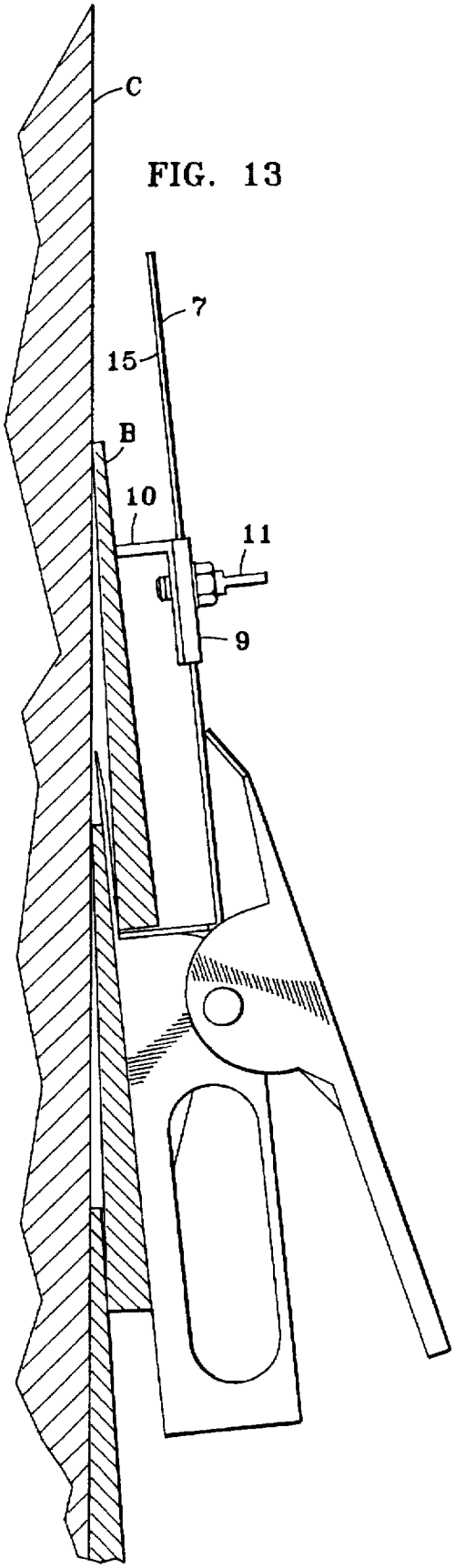

FIG. 13 is a lateral view of the instant invention's clamp unit's lower jaw up and under a course of lain sideboard and in receipt of the instant invention's jig component.

Figure 14:
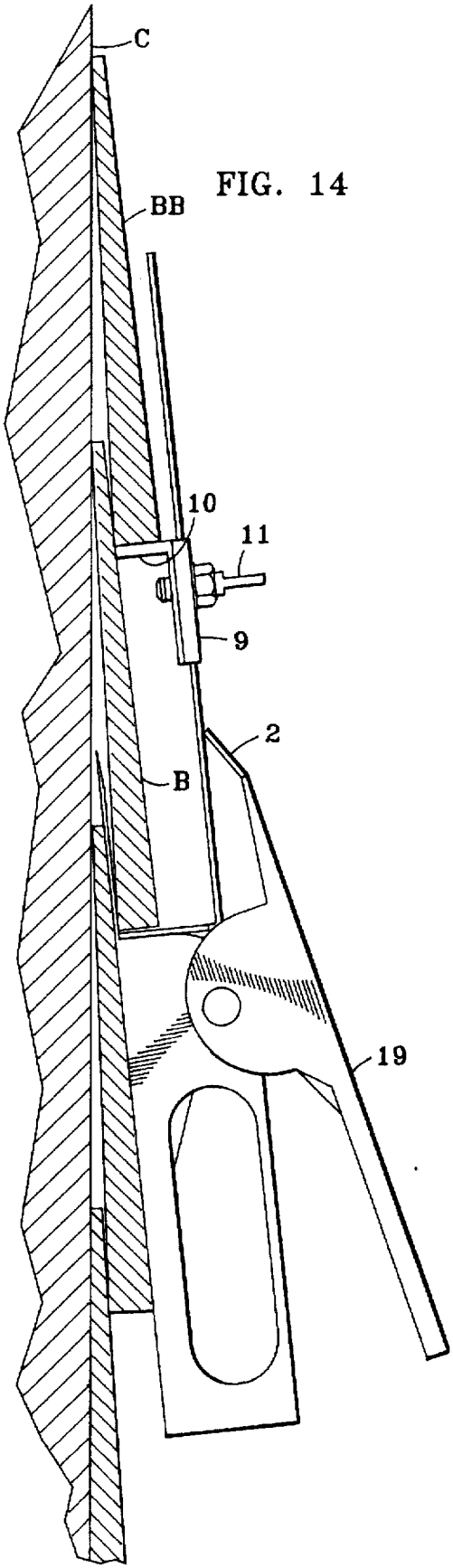

FIG. 14 is a lateral view of the instant invention's clamp unit and received jig component as shown in FIG. 13 but now with a piece of sideboard resting atop the jigstand portion of its jig component.

Figure 15:
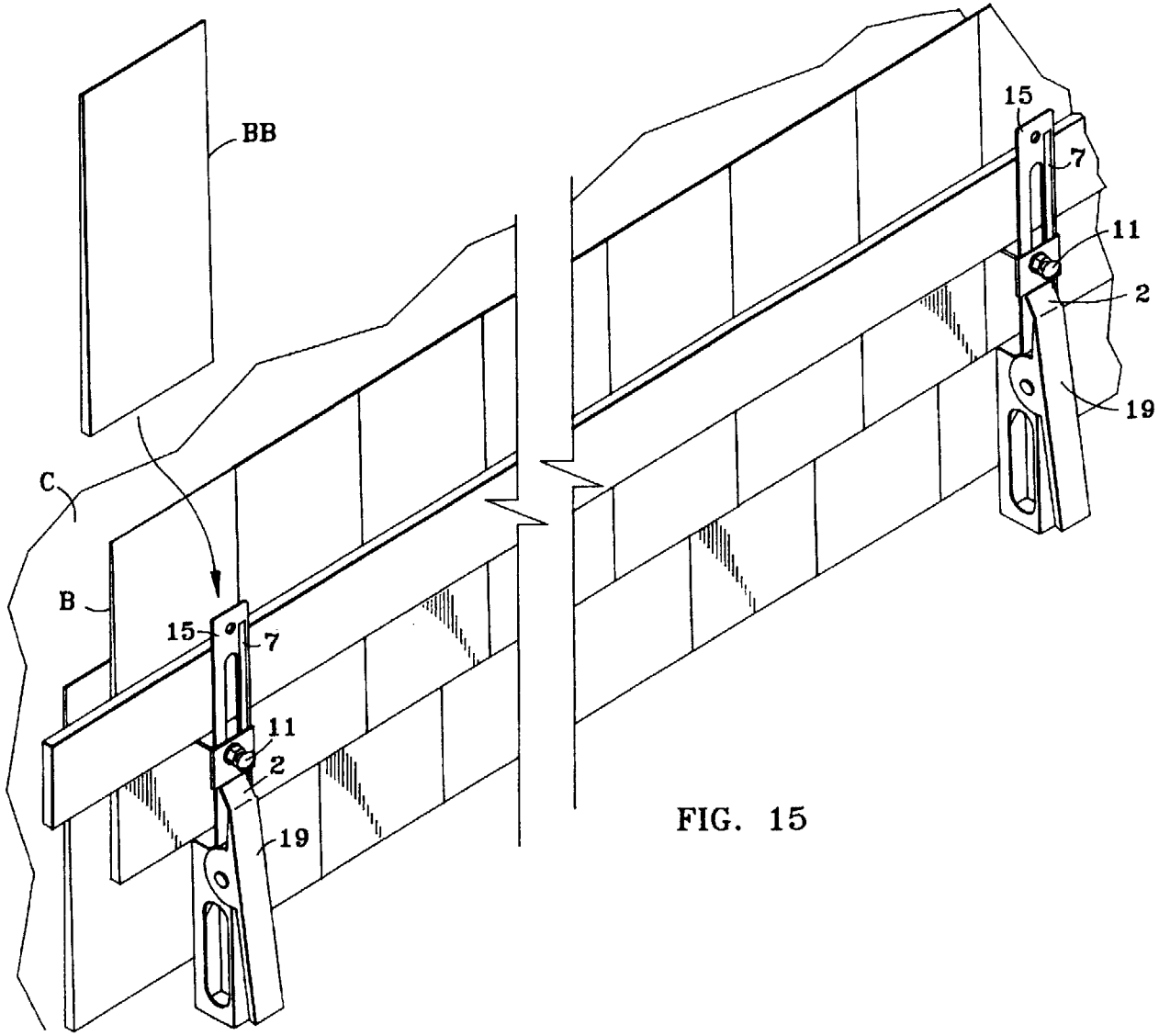

FIG. 15 shows in broad perspective view, two models of the instant invention located near the respective ends of a course of lain shingles and in receipt of a course of shingles to be lain affixed to the previously mentioned course.

Figure 16:
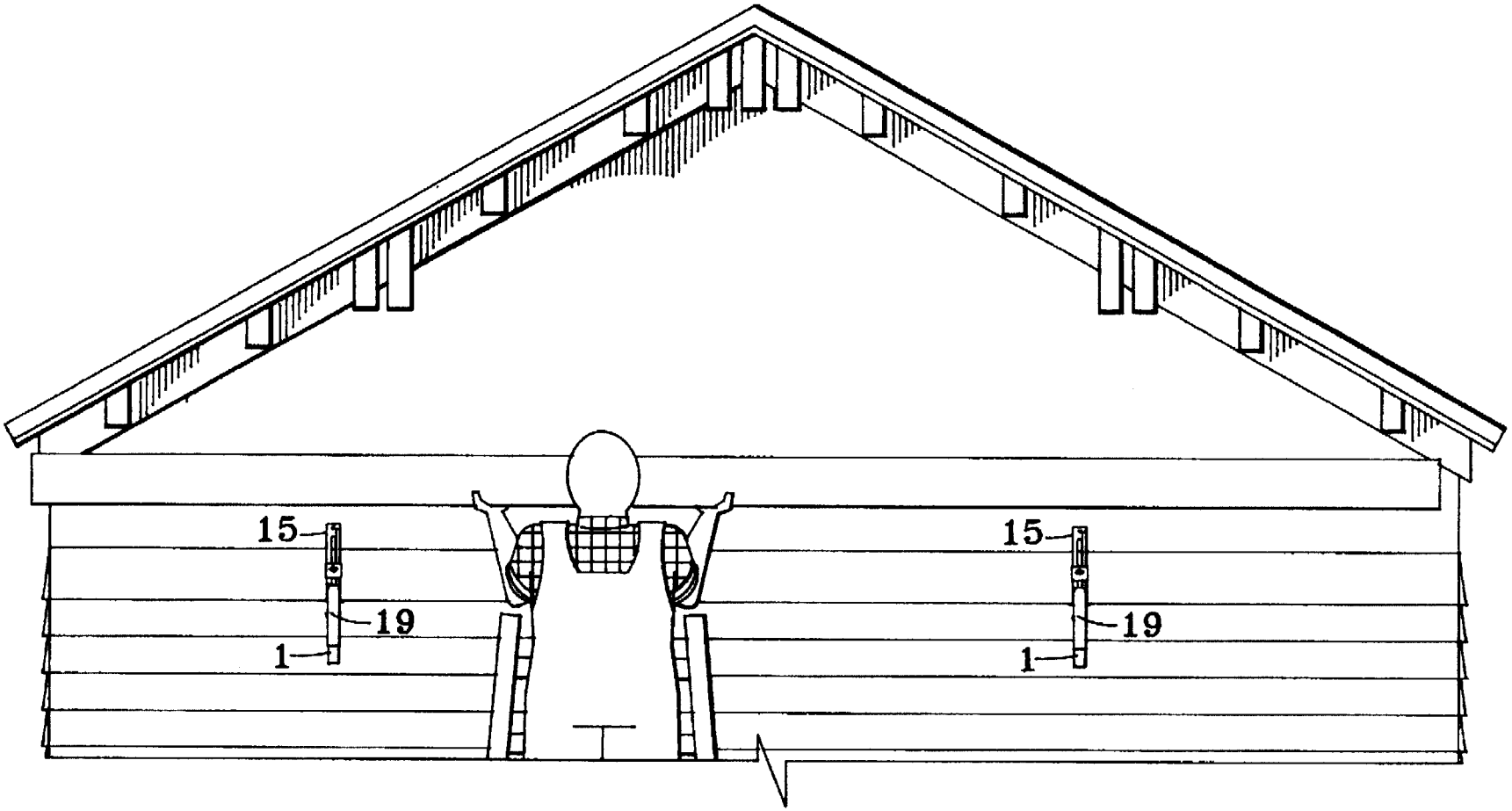

FIG. 16 shows in broad frontal view how one applicator can do the work of two applicators when utilizing two models of the instant invention for the purpose of laying courses of sideboard to the sidewall of a building.

A DESCRIPTION OF THE PREFERRED EMBODIMENTS

Figure 1:
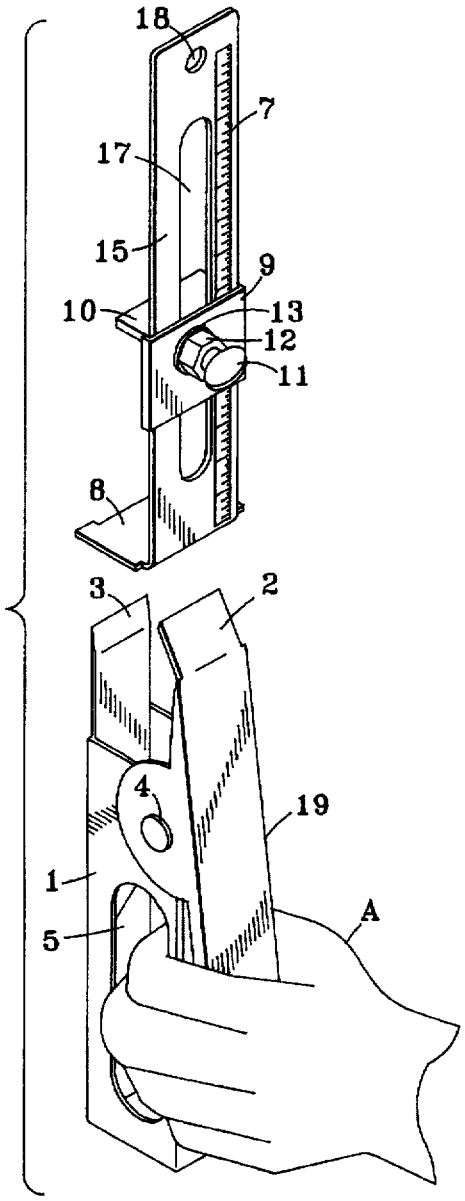
FIG. 1 is an isolated perspective view showing the clamp unit of the instant invention being held open in the hand of an applicator and below the instant invention's jig component.
Figure 2:
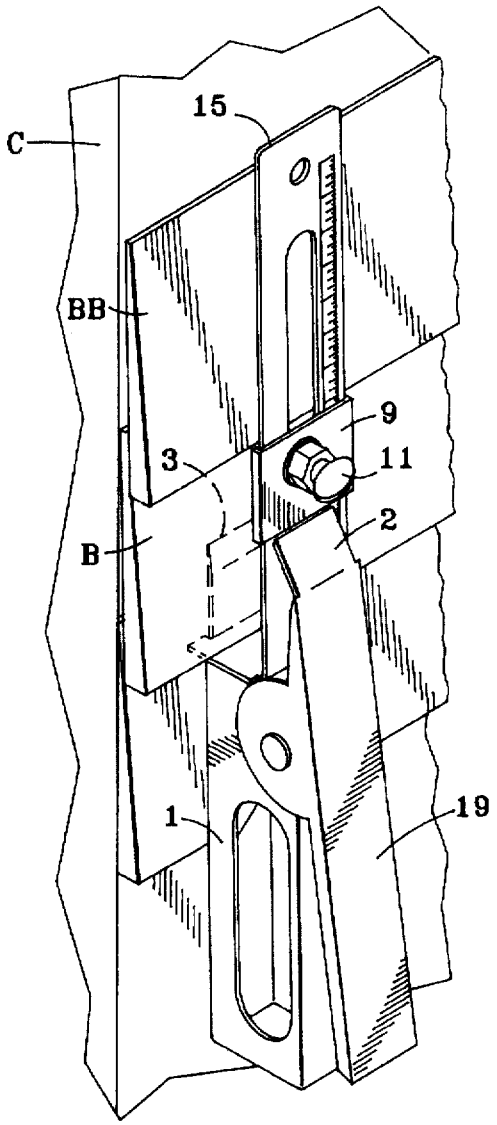
FIG. 2 shows the instant invention's clamp unit's lower jaw up, under a course of sideboard holding the instant invention's jig component against the outer face of that course of sideboard.
Figure 3:
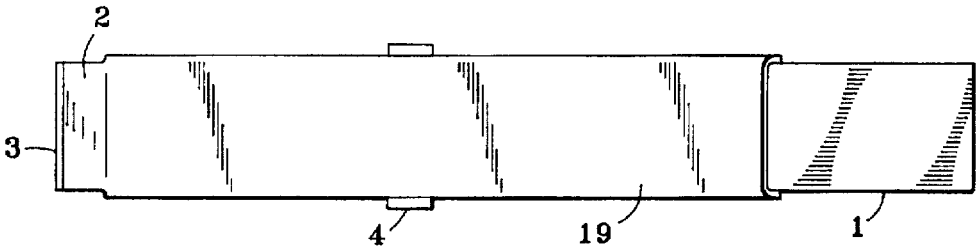
FIG. 3 is a frontal plan view of the instant invention's clamp unit.
Figure 4:
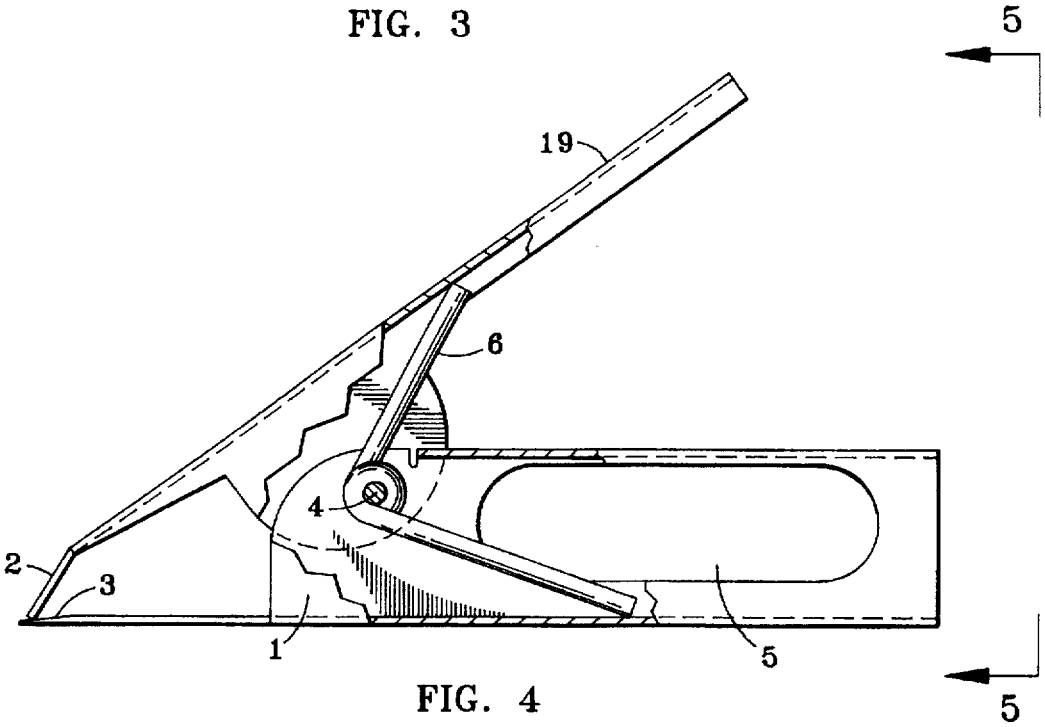
FIG. 4 is a broken, lateral cross-sectional view of the instant invention's clamp unit with closed jaws.
Figure 5:
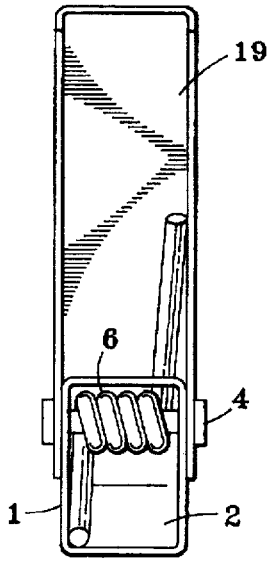
FIG. 5 is a bottom plan view of the instant invention's clamp unit.
Figure 6:
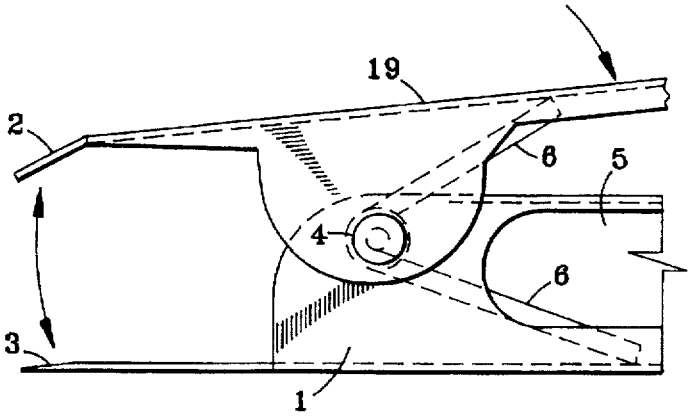
FIG. 6 is an isolated, broken, lateral cross-sectional view of the instant invention's claim unit with opened jaws.

In FIG. 1, it can be noted how the clamp unit 1 of the instant invention is held via holding space 5 in clamp unit 1, by the hand of an applicator A. Applicator A squeezes unit 1 open via holding space 5 after having gripped unit 1 through space 5 as seen in FIG. 1. Lower jaw 3 of clamp unit 1 is then inserted up, under sideboard as seen in FIG. 2 at or near one end of a course B of such sideboard. Clamp unit 1 is opened via squeezing as noted above perforce of the action of an internally wound rat trap spring 6 seen in FIG. 5. It is the action of spring 6 that causes upper jaw 2 to approach and touch lower jaw 3 when clamp unit 1 is left alone, not squeezed open. It is to be seen that the pivotability of upper jaw handle 19 about hingebolt 4 circumscribed within the body of clamp unit 1 by spring 6 is the basis for the clamping action of clamp unit 1. Once lower jaw 3 has been inserted upon and under a course B of laid and affixed sideboard as seen in FIG. 2, the invention's jig component 15 seen in FIG. 1 which is L shaped, is inserted between the outer face of course B in a manner such that the base 8, seen in FIG. 1, of jig component 15 fits just at or below the base edge of course as per FIG. 2. Adjustable jigstand faceplate 9 also seen in FIG. 1 slideable on jig component 15 and jigstand base plate 10 seen in FIG. 11 also slideable and shaped is then moved up or down a certain height above base 8 as can be determined with resort to gauge 7 etched on the front face of jig component 15. When a desired height is achieved, jigstand faceplate 9 is tightened down to jigstand base plate 10 on jig component 15 via rotation of thumbscrew 11 through threaded nut 12. A thin washer 13 seen in FIG. 11 can serve to facilitate such tightening as well. The purpose for jigspace 17 is to serve to accommodate receipt through jig component 15 of the body of thumbscrew 11 for such tightening purposes at any desired height above base 8 within space 17. When thumbscrew 11 is tightened down through nut 12 and hole 14 in the center of jigstand 9, through jigspace 17 and into threaded centerhole 16 of jigstand base plate 10 which is L-shaped, jigstand 9 and plate 10 become firmly tightened to jig component 15 any desired height above base 8.

The protocol outlined above is repeated a second time with a second model of the instant invention only at or near the other end of the previously laid and affixed course B of sideboard with care having been taken to ensure that the jigstand faceplate 9 and jigstand base plate 10 of each model is tightened at one and the same height above the base edge of course B. An applicator A then positions a to be lain and affixed course BB of sideboard so that its bottom edge rests on the top of the shelf portion of L-shaped jigstand base plate 10 of the first model of the instant invention and on the top of the shelf portion of L-shaped jigstand base plate 10 of the second model of the instant invention. Course B is then mailed to course BB and it will be level and parallel in its lie against the sidewall of the building C to which the sideboard is being applied. Once this has been accomplished, then, the clamp units 1 of each model are respectively opened, jig components 15 are removed from the spaces between the outer face of course BB and upper jaws 2 of each model, each model is then pulled out form under course B, and, the whole protocol set forth above is repeated by opening clamp unit 1 of the first model of the instant invention, inserting lower jaw 3 up and under course BB at one end, inserting jig component 15 between the outer face of course B and upper jaw 2, and doing the same things with respect to the second model of the instant invention at the other end of course BB. Then jigstand faceplate 9 and jigstand base plate 10 of the first model are adjusted heightwise and tightened down in the manner noted above to jig component 15 via resort to gauge 7 to a desired height above the base edge of course BB, and, jigstand faceplate 9 of the second model are adjusted and so tightened to the same height above the base edge of course BB, and a new course to be lain sideboard is positioned on the top of the shelf portion of L-shaped jigstand base plate 10 of each model and nailed in place into the just laid on course BB with and parallel to the lie of course BB. FIGS. 12, 13, 14 and 15 pictorially illustrate the foregoing recitations. FIG. 16 illustrates how a whole sidewall of a building C can be covered by courses of sideboard from bottom to top by only one applicator A utilizing a plurality of models of the instant invention in the manner noted above. FIGS. 3, 4, 5 and 6 serve to clearly illustrate how clamp unit 1 is constructed and functions. FIGS. 7 through 11 inclusive enable one to readily appreciate the manner in which jigstand faceplate 9 and jigstand base plate 10 are affixed to jig component 15 so as to readily facilitate the level holding at a desired height of a course of to be lain sideboard. It should be noted that utilization of a plurality of models of the instant invention by an applicator A will enable that person to, while working alone, effectively lay roofing shingles to the topside of a building as well. Simply place lower jaw 3 of a first model's clamp unit 1 under a previously laid down course of shingles at one end of the course. Do the same that the other end of the same course with the lower jaw 3 of a second model's clamp unit 1. Fit a jig component 15 to the first model's open clamp unit 1 so that it's jigstand faceplate 9 and base plate 10 are a desired height above the base edge of the previously laid course. Do the same with respect to a second model at the other end of the course taking care to ensure that jigstand faceplate 9 and base plate 10 of the second model are adjusted and tightened to the same height above the base edge of the previously laid course as with respect to jigstand faceplate 9 and base plate 10 of the first model. Position a straight edge atop the shelf portion of L-shaped jigstand plate 10 of the first model and atop the shelf portion of L-shaped jigstand plate 10 of the second model, then place shingles to be lain atop the straight edge and nail them all into place. The course of shingles thus formed will then lie affixed to the roof a building C parallel with the previously laid course. Then remove and disassemble each model as noted above, followed by a successive repeating of the process of assembling, laying, disassembling, etc., until a whole roof is laid with shingles properly nailed above one another. This just previously articulated protocol can be followed as well if it is desired to lay shingles instead of sideboard to the side walling of a building C. It is worth noting that, at the outset, the first and lowest course to be lain along a sidewall close to level ground or base of a roof is laid without utilization of the instant invention, but, rather instead is laid on and then nailed down with reference to a piece of leveling string so-called. Typically, though not necessarily, a second course is then carefully and slowly laid on and affixed to a sidewall by nailing it to the first laid on course. However, all subsequent courses are laid on and nailed fast in the manner noted above, and, such laying down of courses proceeds relatively quickly, accurately and, because only one applicator A utilizing a plurality of models of the instant invention is required to lay all such courses, indeed most economically. One applicator with one ladder clamping one model at one end, moving himself and his ladder to a second end to clamp a second model, moving his ladder to the center to carry up a to be lain course to place it on appropriately and identically adjusted and tightened down on the shelf portion of jigstand base plates 10 and then moving his ladder to and fro to nail a course in place can work to apply sideboard or shingles in an extremely efficient manner. No longer are two or more applicators working with two or more ladders needed to level, hold and nail to be lain courses of sideboard or shingles to previously laid sideboards and shingles. An optional center hole 18 can be bored into the top of jig component 15 in order to facilitate easy hanging the invention from a nail in a wall when being stored; it being remembered that the clamp portion of the invention will hold fast to the jig component 15 via the action of spring 6 when the invention is not in use.

In closing, respectively submitted once again, the instant invention is new, unquestionably useful and indeed unique, and holds out the promises of revolutionizing the way in which sideboards and shingles are applied to the sidewalls and roofs of buildings.

What is claimed is:

1. A sideboard clamp and jig apparatus, comprising:.

a. a handholdable clamp component with a multi-sided first anterior prong made up of a front side, a first lateral side and a second lateral side and a three sided second posterior prong with a back side pivotably affixed to one another by way of vertically positioned side to side bolt hinge assembly;

b. open spacing within said first lateral side and said second lateral side of said first anterior prong for receipt of the clenched fingers of a person's hand;

c. an upper extension of said front side of said first anterior prong;, d. an upper extension of said back side of said second posterior prong;

e. a rat-trap spring wound about said bolt hinge assembly within the body of said first anterior prong and within the body of said second posterior prong and exerting force upon the inner surface of said front side of said first anterior prong and the inner surface of said back side of said second posterior prong serving to cause said extensions to approach one another when said said prongs of said clamp component are not squeezed together and allowing said extensions to separate from one another when said clamp component's said prongs are squeezed together;

f. an L-shaped jig component, the base of which is flat and perpendicularly affixed to the bottom of the backside of a long rectangularly shaped flat body characterized by the presence within said body of a centrally positioned elliptically shaped space;

g. an L-shaped jigstand base plate, the base of which is flat and perpendicularly affixed to a rectangularly shaped base plate body;

h. a first threaded hole through the center of said rectangularly shaped base plate body;

i. a rectangularly shaped jigstand faceplate component with two perpendicularly and posteriorly inclined extensions of the lateral edges of said faceplate;

j. a second through hole through the center of said jigstand faceplate component such that the central horizontal axis of symmetry of said first hole is one and the same as the central horizontal axis of symmetry of said second hole;

k. means insertable through said first hole and said second hole serving to tighten said faceplate to said base plate about said body of said jig component via said elliptically shaped space.

2. The sideboard clamp and jig apparatus of claim 1, whereby a numbered gauge is etched on to the front face of said body of said jig component.

3. A sideboard claim and jig apparatus, comprising:

a. a handholdable clamp component with a multi-sided first anterior prong made up of a front side, a first lateral side and a second lateral side and a three sided second posterior prong with a back side pivotably affixed to one another by way of a vertically positioned side to side bolt hinge assembly;

b. open spacing within said first lateral side and said second lateral side of said first anterior prong for receipt of the clenched fingers of a person's hand;

c. an upper extension of said front side of said first anterior prong;

d. an upper extension of said back side of said second posterior prong;

e. a rat-trap spring wound about said bolt hinge assembly within the body of said first anterior prong and within the body of said second posterior prong and exerting force upon the inner surface of said front side of said first anterior prong and the inner surface of said back side of said second posterior prong serving to cause said extensions to approach one another when said said prongs of said clamp component are not squeezed together and allowing said extensions to separate from one another when said clamp component's said prongs are squeezed together;

f. an L-shaped jig component, the base of which is flat and perpendicularly affixed to the bottom of the backside of a long rectangularly shaped flat body characterized by the presence within said body of a centrally positioned elliptically shaped space;

g. an L-shaped jigstand base plate, the base of which is flat and perpendicularly affixed to a rectangularly shaped base plate body;

h. a first threaded hole through the center of said rectangularly shaped base plate body;

i. a rectangularly shaped jigstand faceplate component with two perpendicularly and posteriorly inclined extensions of the lateral edges of said faceplate;

j. a second through hole through the center of said jigstand faceplate component such that the central horizontal axis of symmetry of said first hole is one and the same as the central horizontal axis of symmetry of said second hole;

k. a thumbscrew insertable through a threaded nut and through said first hole and said second hole serving to tighten said face plate to said base plate about said body of said jig component via said elliptically shaped space.

4. The sideboard clamp and jig apparatus of claim 3, whereby a numbered gauge is etched on to the front face of said body of said jig component.

5. A sideboard clamp and jig apparatus, comprising:

a. a handholdable clamp component with a multi-sided first anterior prong made up of a front side, a first lateral side and a second lateral side and a three sided second posterior prong with a back side pivotably affixed to one another by way of a vertically positioned side to side bolt hinge assembly;

b. open spacing within said first lateral side and said second lateral side of said first anterior prong for receipt of the clenched fingers of a person's hand;

c. an upper extension of said front side of said first anterior prong;

d. an upper extension of said back side of said second posterior prong;

e. a rat-trap spring wound about said bolt hinge assembly within the body of said first anterior prong and within the body of said second posterior prong and exerting force upon the inner surface of said front side of said first anterior prong and the inner surface of said back side of said second posterior prong serving to cause said extensions to approach one another when said said prongs of said claim component are not squeezed together and allowing said extensions to separate from one another when said clamp component's said prongs are squeezed together;

f. an L-shaped jig component, the base of which is flat and perpendicularly affixed to the bottom of the backside of a long rectangularly shaped flat body characterized by the presence within said body of a centrally positioned elliptically shaped space;

g. an L-shaped jigstand base plate, the base of which is flat and perpendicularly affixed to a rectangularly shaped base plate body;

h. a first threaded hole through the center of said rectangularly shaped base plate body;

i. a rectangularly shaped jigstand faceplate component with two perpendicularly and posteriorly inclined extensions of the lateral edges of said faceplate;

j. a second through hole through the center of said jigstand faceplate component such that the central horizontal axis of symmetry of said first hole is one and the same as the central horizontal axis of symmetry of said second hole;

k. a thumbscrew insertable through a threaded nut and a circular washer positioned flat against the base of said nut through said first hole and said second hole serving to tighten said face plate to said base plate about said body of said jig component via said elliptically shaped space.

6. The sideboard clamp and jig apparatus of claims 5, whereby a numbered gauge is etched on to the front face of said body of said jig component.

7. A sideboard clamp and jig apparatus, comprising:

a. a handholdable clamp component with a multi-sided first anterior prong made up of a front side, a first lateral side and a second lateral side and a three sided second posterior prong with a back side pivotably affixed to one another by way of a vertically positioned side to side bolt hinge assembly;

b. open spacing within said first lateral side and said second lateral side of said first anterior prong for receipt of the clenched fingers of a person's hand;

c. an upper extension of said front side of said first anterior prong;

d. an upper extension of said back side of said second posterior prong;

e. a rat-trap spring wound about said bolt hinge assembly within the body of said first anterior prong and within the body of said second anterior prong and exerting force upon the inner surface of said front side of said first anterior prong and the inner surface of said back side of said second posterior prong serving to cause said extensions to approach one another when said said prongs of said claim component are not squeezed together and allowing said extensions to separate from one another when said clamp component's said prongs are squeezed together;

f. an L-shaped jig component, the base of which is flat and perpendicularly affixed to the bottom of the backside of a long rectangularly shaped flat body characterized by the presence within said body of a centrally positioned elliptically shaped space;

g. an L-shaped jigstand base plate, the base of which is flat and perpendicularly affixed to a rectangularly shaped base plate body;

h. a first threaded hole through the center of said rectangularly shaped base plate body;

i. a rectangularly shaped jigstand faceplate;

j. a second through hole through the center of said jigstand faceplate component such that the central horizontal axis of symmetry of said first hole is one and the same as the central horizontal axis of symmetry of said second hole;

k. means insertable through said first hole and said second hole serving to tighten said faceplate to said base plate about said body of said jig component via said elliptically shaped space.

8. The sideboard clamp and jig apparatus of claim 7, whereby a numbered gauge is etched on to the front face of said body of said jig component.

* * * * *